US009976300B2

(12) United States Patent
Hall et al.

(10) Patent No.: US 9,976,300 B2
(45) Date of Patent: May 22, 2018

(54) ROLL-UP WALL

(71) Applicants: David R. Hall, Provo, UT (US); Andrew Priddis, Mapleton, UT (US); Charles Wood, Springville, UT (US); Joe Fox, Spanish Fork, UT (US); Kelly Knight, Provo, UT (US)

(72) Inventors: David R. Hall, Provo, UT (US); Andrew Priddis, Mapleton, UT (US); Charles Wood, Springville, UT (US); Joe Fox, Spanish Fork, UT (US); Kelly Knight, Provo, UT (US)

( * ) Notice: Subject to any disclaimer, the term of this patent is extended or adjusted under 35 U.S.C. 154(b) by 13 days.

(21) Appl. No.: 15/278,679

(22) Filed: Sep. 28, 2016

(65) Prior Publication Data

US 2018/0087269 A1 Mar. 29, 2018

(51) Int. Cl.

| | |
|---|---|
| ***E06B 9/44*** | (2006.01) |
| ***E04B 2/74*** | (2006.01) |
| ***E06B 9/08*** | (2006.01) |
| ***E06B 9/58*** | (2006.01) |
| *E06B 9/172* | (2006.01) |

(52) U.S. Cl.

CPC ..... *E04B 2/7403* (2013.01); *E06B 9/08* (2013.01); *E06B 9/58* (2013.01); *E06B 9/582* (2013.01); *E06B 9/172* (2013.01); *E06B 9/44* (2013.01)

(58) Field of Classification Search

CPC ..... E06B 9/44; E06B 9/46; E06B 9/48; E06B 9/171; E06B 9/172; E06B 9/173; E06B 9/582; E06B 9/581; E06B 9/58; E06B 2009/445

USPC ..... 160/48, 46, 382–404

See application file for complete search history.

(56) References Cited

U.S. PATENT DOCUMENTS

| | | | | | |
|---|---|---|---|---|---|
| 642,041 | A * | 1/1900 | Gutner | E04B 1/3211 | 160/399 |
| 684,674 | A * | 10/1901 | Clark | A47C 31/04 | 123/71 R |
| 816,490 | A * | 3/1906 | Mills | E04B 1/3211 | 160/399 |
| 1,099,660 | A * | 6/1914 | Mead | E06B 9/48 | 160/401 |
| 1,200,977 | A * | 10/1916 | Pierce | A47C 31/04 | 160/402 |
| 1,333,906 | A * | 3/1920 | De Villers | E06B 9/172 | 160/387 |
| 1,345,447 | A * | 7/1920 | Johnson | E06B 9/15 | 160/133 |

(Continued)

*Primary Examiner* — Katherine W Mitchell
*Assistant Examiner* — Johnnie A. Shablack

(57) ABSTRACT

The present invention is directed to a roll-up wall. The roll-up wall and its components may be used to divide existing larger spaces into smaller spaces with a sound-attenuating barrier. In this invention a sound-attenuating panel is attached to a roller drum which, when turned on its axis by a winding mechanism, deploys or retracts the sound-attenuating panel. This invention discloses details of the sound-attenuating panel, the roller drum, a sound-attenuating guide system, a lower sound-attenuating seal, and an interlocking system. More particularly, this invention discloses an interlocking system which removably attaches a sound-attenuating panel to a roller drum. This invention discloses a plurality of embodiments of the interlocking system and provides detailed descriptions of each embodiment.

20 Claims, 18 Drawing Sheets

(56) References Cited

U.S. PATENT DOCUMENTS 1,406,685 A * 2/1922 Rohr ..... A47H 1/00 160/393
1,462,171 A * 7/1923 Greninger ..... E06B 9/46 160/323.1
1,477,159 A * 12/1923 Zinser ..... E06B 9/48 160/294
1,553,862 A * 9/1925 Kirsch ..... E06B 9/48 160/398
1,559,530 A * 10/1925 Yehle ..... E06B 9/48 160/401
1,559,531 A * 10/1925 Yehle ..... E06B 9/48 160/401
1,567,674 A * 12/1925 Pease ..... E04F 10/02 160/387
1,620,159 A * 3/1927 Levy ..... E06B 9/48 160/264
1,725,269 A * 8/1929 Hartshorn ..... E06B 9/48 160/301
1,747,081 A * 2/1930 Reukauf, Jr. ..... E06B 9/48 160/404
1,749,595 A * 3/1930 Mark ..... E06B 9/48 160/400
1,765,145 A * 6/1930 Gillbee ..... E06B 9/44 160/390
1,776,119 A * 9/1930 Johnson ..... E06B 9/171 160/133
1,782,977 A * 11/1930 Soderqvist ..... E06B 9/44 160/263
1,795,261 A * 3/1931 Murphy ..... E06B 9/48 160/238
1,813,980 A * 7/1931 Williams ..... E06B 9/48 160/385
1,815,769 A * 7/1931 Goldburg ..... E06B 9/48 160/390
1,996,615 A * 4/1935 Gill ..... A47H 21/00 160/38
2,022,807 A * 12/1935 Hagerty ..... E06B 9/46 160/396
2,253,519 A * 8/1941 Hicks ..... E06B 9/44 160/399
2,322,092 A * 6/1943 Johnson ..... E06B 9/48 160/402
2,336,189 A * 12/1943 Price ..... E06B 9/48 160/397
2,397,775 A * 4/1946 Burns ..... E06B 9/48 160/390
2,599,410 A * 6/1952 Probst ..... E06B 9/44 160/400
2,618,333 A * 11/1952 Judd ..... E06B 9/44 160/400
2,792,612 A * 5/1957 Wickliffe ..... F16B 2/06 160/402
4,258,517 A * 3/1981 Hammond ..... E06B 9/582 160/269
4,282,919 A * 8/1981 Teno ..... E06B 9/17015 160/23.1
4,335,774 A * 6/1982 Price ..... E06B 9/24 160/329
4,357,978 A * 11/1982 Keller ..... E06B 9/17046 160/271
4,398,585 A * 8/1983 Marlow ..... E06B 9/17076 160/23.1
4,399,855 A * 8/1983 Volfson ..... E06B 9/11 160/23.1
4,436,137 A * 3/1984 Charles ..... B01J 3/08 160/242
4,478,268 A * 10/1984 Palmer ..... B65G 69/008 160/272
4,601,320 A * 7/1986 Taylor ..... E06B 9/40 160/133
4,633,927 A * 1/1987 Labelle ..... E06B 9/171 160/133
4,712,598 A * 12/1987 Bonacci ..... E06B 9/262 160/327
5,117,892 A * 6/1992 Murray ..... E06B 9/54 160/269
5,123,474 A * 6/1992 Smith ..... E06B 9/13 160/273.1
5,542,463 A * 8/1996 Pinkalla ..... E06B 3/80 160/121.1
5,899,254 A * 5/1999 Cook ..... E06B 9/54 160/321
6,145,571 A * 11/2000 Snyder ..... E06B 9/58 160/1
6,237,667 B1 * 5/2001 Fraczek ..... E06B 9/46 160/121.1
6,247,517 B1 * 6/2001 Drifka ..... E06B 9/13 160/23.1
6,390,171 B2 * 5/2002 Drifka ..... E06B 9/13 160/23.1
6,497,267 B1 * 12/2002 Azar ..... E06B 9/42 160/188
6,722,416 B2 * 4/2004 Varley ..... E06B 9/13 160/264
6,931,673 B1 * 8/2005 Savage, Jr. ..... E04H 4/101 160/290.1
7,063,124 B2 * 6/2006 Walker ..... E06B 9/46 160/392
7,111,661 B2 * 9/2006 Laugenbach ..... E06B 9/13 160/133
7,562,743 B2 * 7/2009 Beeson ..... E06B 5/20 160/216
7,614,439 B2 * 11/2009 Lukos ..... E04F 10/0633 160/310
8,327,905 B2 * 12/2012 McDonald ..... E06B 3/483 160/213
8,371,355 B2 * 2/2013 Santoro ..... E06B 9/42 160/268.1
8,617,715 B2 * 12/2013 Shively ..... A47H 23/08 428/423.7
8,723,454 B2 * 5/2014 Skinner ..... E06B 9/322 318/16
8,807,275 B2 * 8/2014 Wilson ..... E01F 8/0088 181/200
9,133,658 B2 * 9/2015 Kuperus ..... E06B 9/40
9,222,304 B2 * 12/2015 Casey ..... E06B 9/581
9,309,669 B2 * 4/2016 Duran Ariza ..... E04B 2/827
9,341,021 B2 * 5/2016 Lu ..... E06B 9/56
9,410,371 B2 * 8/2016 Faller ..... E06B 9/322
9,428,955 B2 * 8/2016 Fleischman ..... E06B 9/58
9,493,984 B2 * 11/2016 Casey ..... E06B 9/581
9,512,612 B2 * 12/2016 Gower ..... E04B 1/40
9,567,802 B2 * 2/2017 Buccola, Jr. ..... E06B 9/322
2001/0017193 A1 * 8/2001 Duric ..... E06B 9/44 160/321
2004/0065417 A1 * 4/2004 Vanpoelvoorde ..... E06B 9/388 160/84.05
2007/0256799 A1 * 11/2007 Lin ..... B60J 1/2041 160/273.1
2008/0011432 A1 * 1/2008 Seysen ..... E06B 9/13 160/309
2008/0099156 A1 * 5/2008 Kraeutler ..... E06B 7/2305 160/84.01
2008/0216969 A1 * 9/2008 Barkman ..... E06B 9/386 160/236
2009/0014134 A1 * 1/2009 Hanley ..... E06B 9/42 160/266
2009/0056886 A1 * 3/2009 Shaw ..... E04B 3/80 160/368.1
2009/0277593 A1 * 11/2009 Stewart ..... E06B 9/40 160/127
2009/0277594 A1 * 11/2009 Stewart ..... E06B 9/40 160/311
2009/0278703 A1 * 11/2009 Iglesias Ballester ..... E06B 9/11 340/1.1
2010/0326606 A1 * 12/2010 Barkman ..... E06B 9/386 160/188

(56) References Cited

U.S. PATENT DOCUMENTS

2012/0012260 A1* 1/2012 Elinson ..... E06B 9/42 160/240
2012/0049142 A1* 3/2012 Lill ..... E01F 15/043 256/13.1
2012/0168094 A1* 7/2012 Lin ..... E06B 9/262 160/84.04
2013/0098566 A1* 4/2013 Horvath ..... E06B 9/58 160/273.1
2013/0240291 A1* 9/2013 Tinianov ..... E04B 1/86 181/294
2014/0262076 A1* 9/2014 Mullet ..... E06B 9/58 160/295
2014/0262084 A1* 9/2014 Fleischman ..... E06B 9/58 160/368.1
2015/0308187 A1* 10/2015 Lu ..... E06B 9/42 160/319
2015/0337529 A1* 11/2015 Duran Ariza ..... E04B 2/827 52/64
2015/0345216 A1* 12/2015 Feldstein ..... E06B 9/50 160/310
2015/0361717 A1* 12/2015 van 't Zelfde ..... E06B 9/40 160/309
2016/0032646 A1* 2/2016 Fleischman ..... E06B 9/40 160/309
2016/0090777 A1* 3/2016 Brunton ..... E06B 9/582 160/133
2016/0108666 A1* 4/2016 Lewan ..... E06B 9/58 160/271
2016/0130872 A1* 5/2016 Munsters ..... E06B 9/40 160/309
2016/0166101 A1* 6/2016 Kinsey ..... A47H 23/08 160/330
2016/0258154 A1* 9/2016 Logic ..... E04B 2/72
2016/0319595 A1* 11/2016 Dwarka ..... E06B 9/17007
2016/0326801 A1* 11/2016 Blair ..... E06B 9/72
2016/0369556 A1* 12/2016 Fleishman ..... E06B 9/58
2016/0376788 A1* 12/2016 Duran Ariza ..... E04B 2/827 52/64
2017/0009524 A1* 1/2017 Dwarka ..... E06B 9/24
2017/0037616 A1* 2/2017 Fleischman ..... E04C 2/46
2017/0081910 A1* 3/2017 Gower ..... E04B 1/40
2017/0159358 A1* 6/2017 Alonso Fabregat .... E06B 9/581
2017/0211315 A1* 7/2017 Fleischman ..... E06B 9/17
2017/0275945 A1* 9/2017 Hall ..... E06B 9/72
2017/0275946 A1* 9/2017 Hall ..... E06B 9/72

* cited by examiner

ROLL-UP WALL

BACKGROUND

Field of the Invention

This invention generally relates to systems for retractable and roll-up walls. More particularly, this invention relates to roll-up walls where the wall is connected to the roller drum by way of an interlocking system which allows the roll-up wall to be removably attached to a roller drum.

Background of the Invention

A retractable or roll-up wall comprises one or more flexible sheets of various materials that are wound about a roller or otherwise coiled above an open space. To create a wall, partition, or divider within a larger space, the flexible sheet is deployed downward from the roller. Retractable and roll-up walls provide the ability to divide space in short sections, along a longer continuum, and in some applications into smaller cordoned spaces within a larger space. Retractable and roll-up walls provide flexibility in space structure and usage, and may be preferred over permanent walls in some applications. In some existing applications, retractable and roll-up walls may be frame mounted with posts at each angled intersection, to which the retractable or roll-up wall may be attached when deployed. When retracted, the wall is no longer disposed in the space, but the problem remains that the corner posts are still present. Where a framework is required to deploy a retractable or roll-up wall system, additional time and expense is required in each instance of deploying or removing the framework prior to deploying the roll-up walls and after retracting the roll-up walls. Some applications may require sound-attenuation which may not be achieved by typical flexible wall material used in retractable walls. The need exists for the ability to create smaller independent spaces with greater flexibility.

SUMMARY

This invention has been developed in response to the present state of the art and, in particular, in response to the problems and needs in the art that have not yet been fully solved by currently available retractable or roll-up wall systems and deployment methods. Accordingly, a roll-up wall has been developed that is connected to a roller drum by use of an interlocking system that allows operators to quickly remove one flexible wall and exchange it with another, and do so in close-quarters and in a short time frame. Features and advantages of different embodiments of the invention will become more fully apparent from the following description and appended claims, or may be learned by practice of the invention as set forth hereinafter.

Consistent with the foregoing, a roll-up wall is disclosed. The composition of a flexible, sound-attenuating panel is disclosed. A roller drum around which the panel rolled is disclosed. A means for winding the roller drum to raise or lower the panel is disclosed. A mounting system is disclosed. An interlocking system used to removably attach the panel to the roller drum is disclosed. A system for guiding the panel as it deploys is disclosed. A system for sealing the lower edge of the panel at a floor surface is disclosed.

Wall is defined as any wall, partition, or divider used for the purpose of cordoning off a section of a larger space to create smaller spaces. Although any number of embodiments may be considered, the following suggest one example: a room of the dimension 10 feet by 20 feet may be divided into two rooms, each room 10 feet by 10 feet, by deploying a single flexible panel.

Sound-attenuation is defined as reducing the level of sound that passes through a medium. In the instance of the material used in this invention, mass loaded vinyl, the material absorbs the energy created by sound waves thus reducing the transference of sound from one side of the material to the other side.

Interlocking system is defined as a plurality of connecting mechanisms, one which attaches to a panel and the other which attaches to a roller drum. Each embodiment of the system comprises connecting mechanisms that run the width of the panel and the length of the roller drum.

DETAILED DESCRIPTION OF CERTAIN EMBODIMENTS

It will be readily understood that the components of the present invention, as generally described and illustrated in the Figures herein, may be designed in a wide variety of different configurations. Thus, the following more detailed description of the embodiments of the invention is not intended to limit the scope of the invention, as claimed, but is merely representative of certain examples of presently contemplated embodiments in accordance with the invention. The presently described embodiments will be best understood by reference to the claims and drawings.

In one embodiment the interlocking system comprises sectional connector brackets. A plurality of said brackets are spaced evenly and longitudinally along the length of a roller drum. A plurality of complimentary brackets are spaced evenly along the upper end of a panel for the width of the panel and positioned correspondingly to brackets disposed on the roller drum. Features and advantages of additional embodiments of the invention may become more fully apparent or may be learned by practice of the invention as set forth hereinafter.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION OF THE DRAWINGS

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
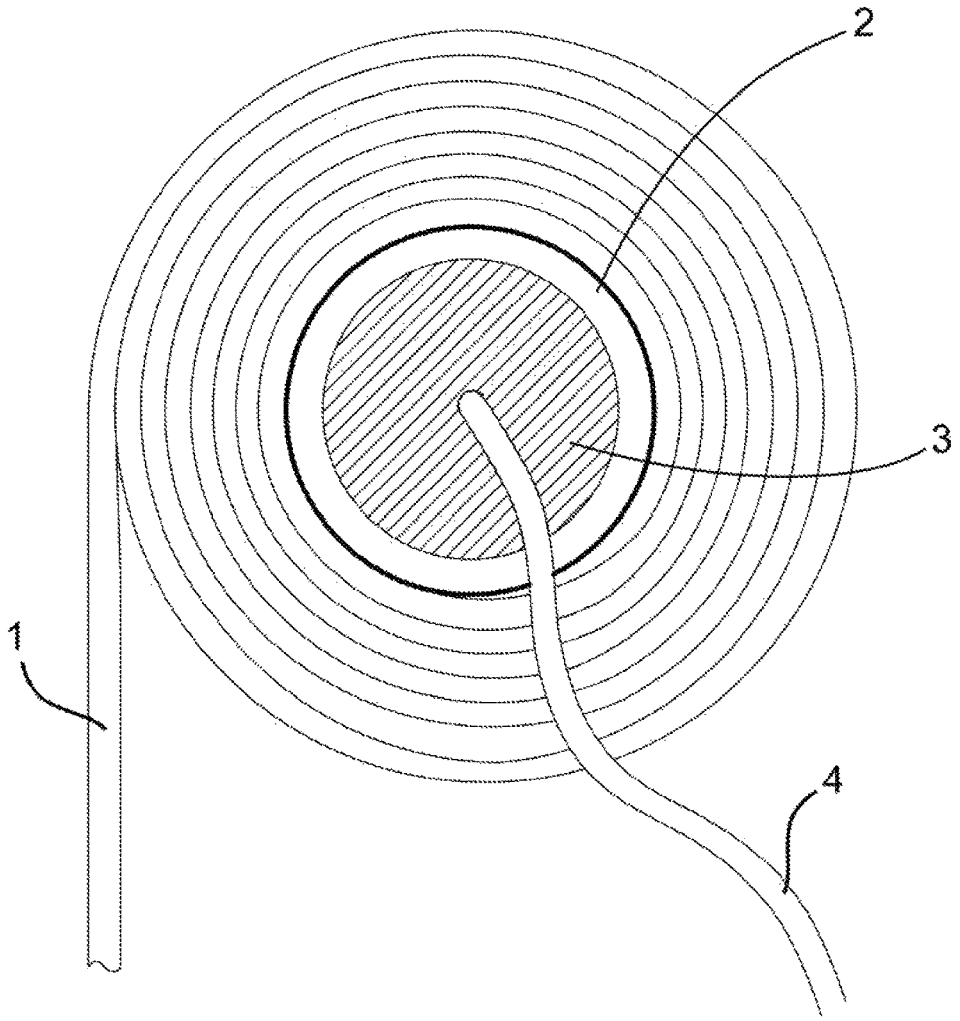
FIG. 1 is a profile view comprising the flexible roll-up panel, with the panel rolled around a roller drum, a winding mechanism, and in this embodiment a power cord leading to the winding mechanism.

FIG. 1 is a profile view comprising a sound-attenuating panel 1 rolled about a roller drum 2, a winding mechanism 3 disposed on the interior of and attached to the roller drum 2, and a power cord 4 leading from the winding mechanism 3. The sound-attenuating panel 1 comprises mass loaded vinyl, which has sound attenuating properties that reduce the transference of sound from one side of the material to the other side through absorption of the sound waves. In one embodiment, the roller drum 2 is made of aluminum. In other embodiments the roller drum 2 comprises steel, stainless steel, brass, titanium, polyvinyl chloride, wood, carbon fiber, engineered wood, nylon, and plastic.

Figure 2A:
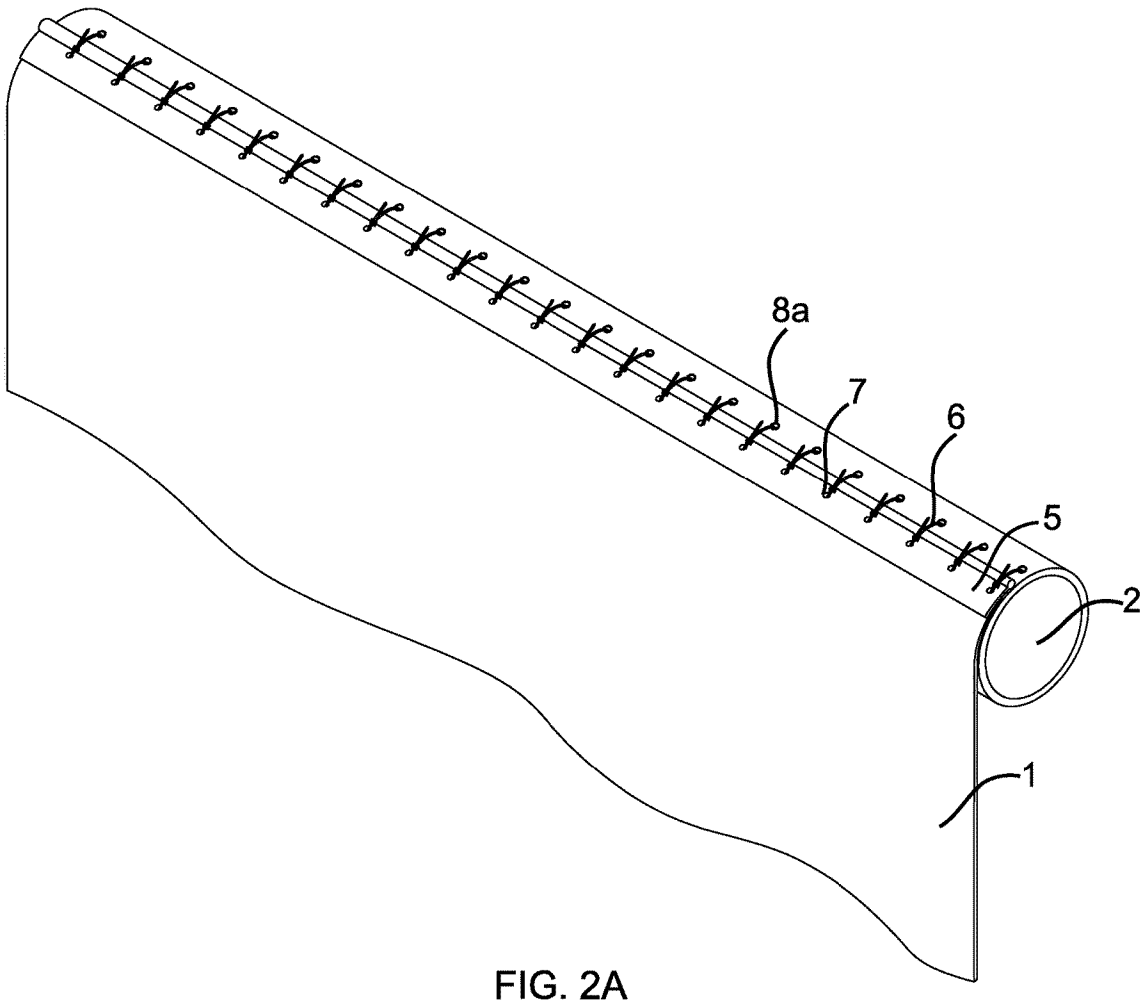
FIGS. 2A through 7 show different embodiments and views of the interlocking system and connecting mechanisms used to removably attach the flexible panel to the roller drum.
Figure 2B:
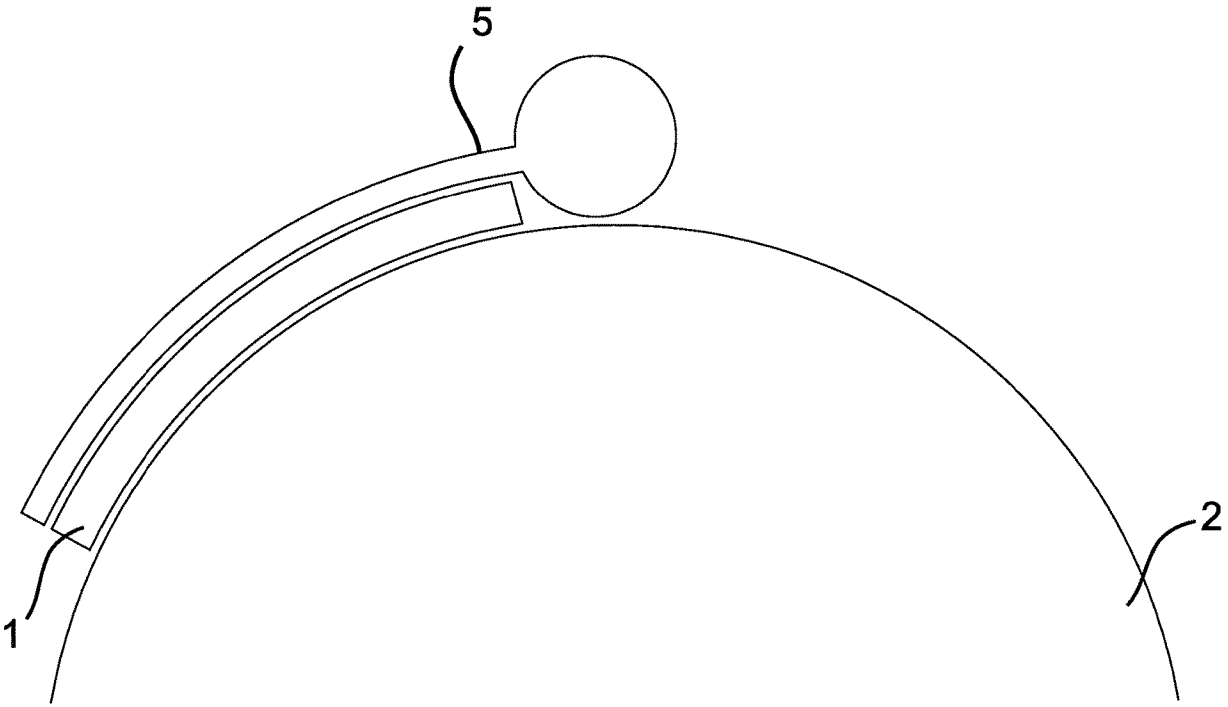
Figure 2C:
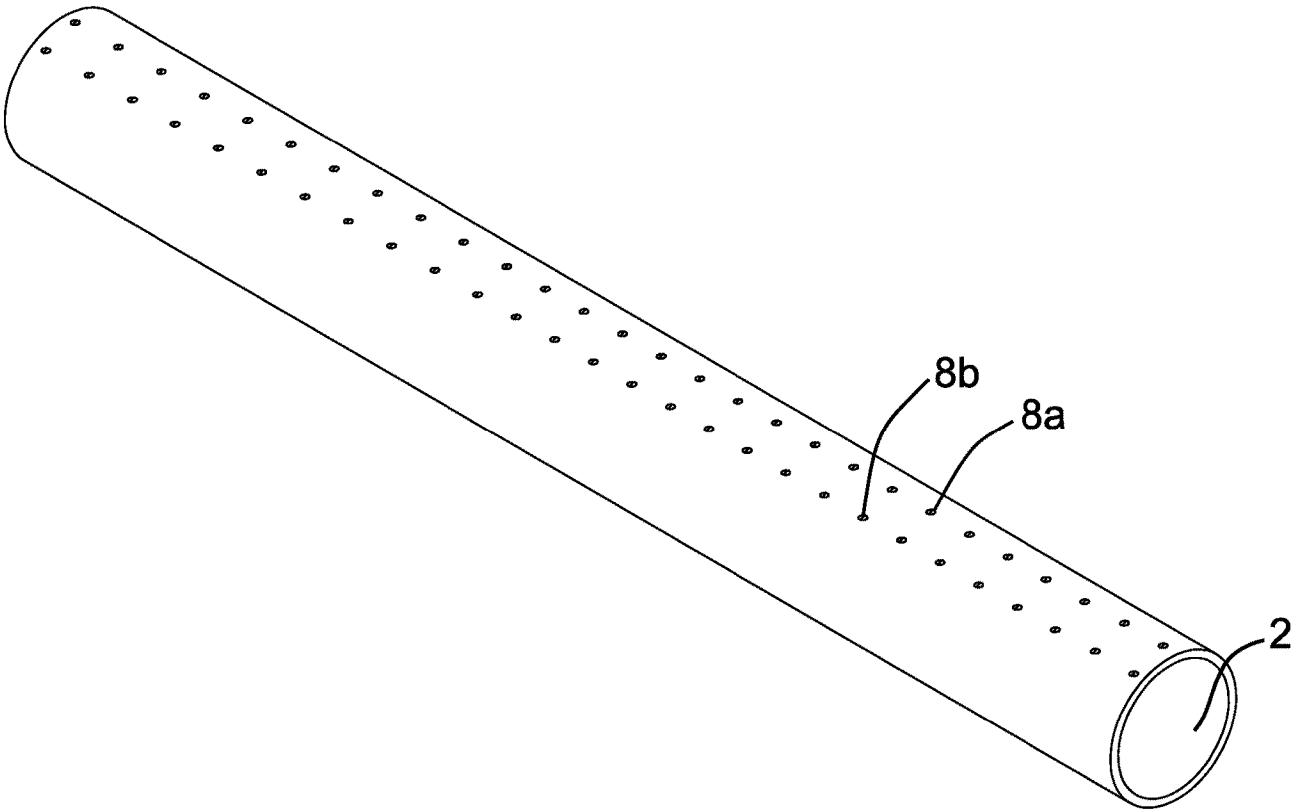

FIGS. 2A through 2C show multiple views depicting the sound-attenuating panel 1, the roller drum 2, and one embodiment of an interlocking system comprising 5, 6, 7, 8*a*, and 8*b*. The sound-attenuating panel 1 comprises an upper side, a lower side, and first vertical side, and a second vertical side. On the upper side of the sound-attenuating panel 1, disposed longitudinally for the width of the sound-attenuating panel 1 is one embodiment of the interlocking system using a convex coupling mechanism 5. Coupling mechanism 5 comprises a first flat surface and a second flat surface, a round longitudinal edge, and a flat edge opposite the round edge as shown in FIG. 2B. In this embodiment, one surface of the coupling mechanism 5 is joined to one surface of the sound-attenuating panel 1 by way of chemical attachment. In other embodiments, the coupling mechanism 5 is joined to the sound-attenuating panel 1 using adhesives, rivets, and mechanical attachments. In this embodiment, the coupling mechanism 5 is made of rubber. In other embodiments, the coupling mechanism 5 comprises polyvinyl chloride, plastic, aluminum, titanium, carbon fiber and acrylic. Also shown are grommets 7 which are intermittently spaced longitudinally along the flat surface of the coupling mechanism 5, with a hole perforated through the flat surface of the coupling mechanism 5 and the sound-attenuating panel 1 at each grommet 7. Shown in FIG. 2A is one row of holes 8*a* intermittently spaced longitudinally the length of the roller drum 2. FIG. 2C shows two rows of holes 8*a* and 8*b* disposed intermittently and spaced apart along the roller drum 2. Holes 8*b* are disposed in roller tube 2 directly beneath the grommets 7 shown in 2A. Zip ties 6 pass through the grommets 7 and the corresponding holes 8*b* then through the corresponding hole 8*a*, removably attaching the sound-attenuating panel 1 to the roller drum 2.

Figure 3A:
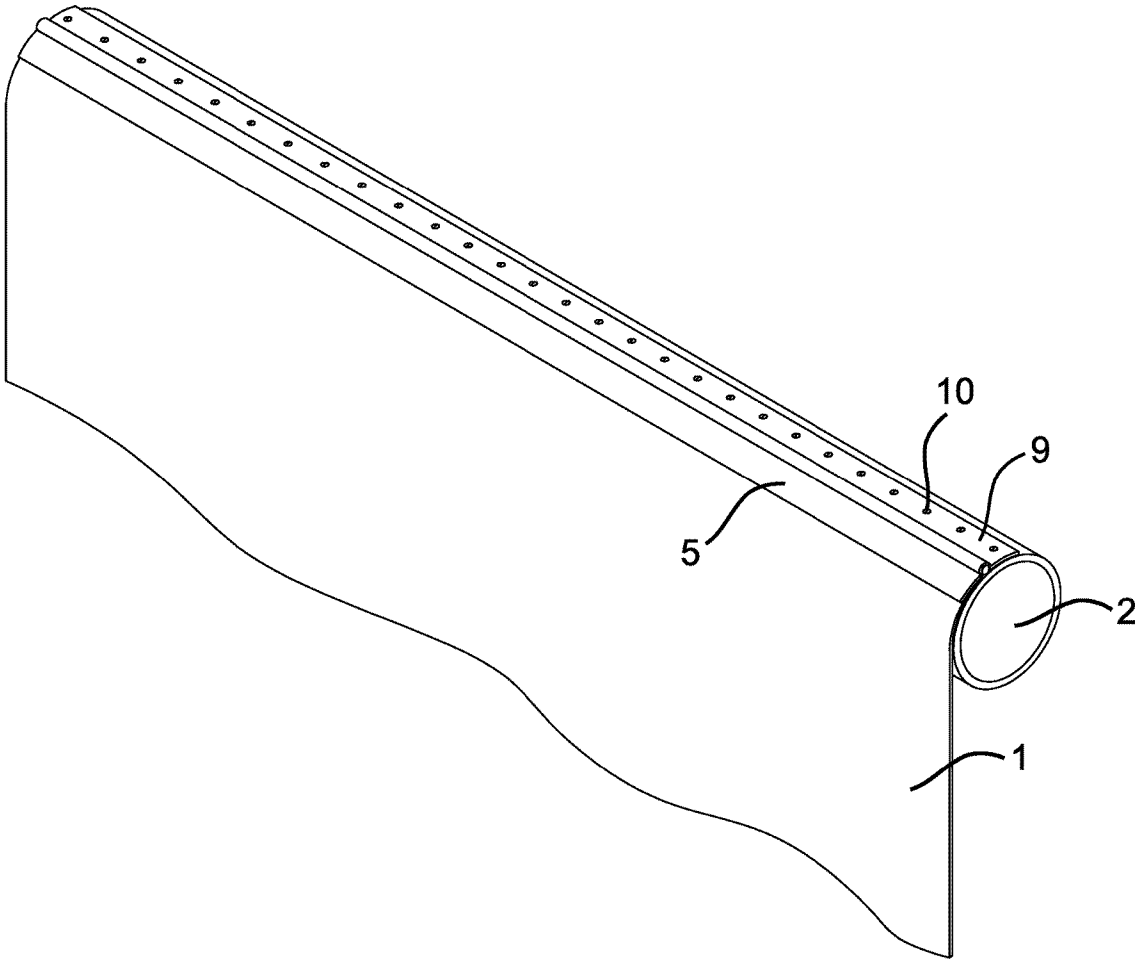
Figure 3B:
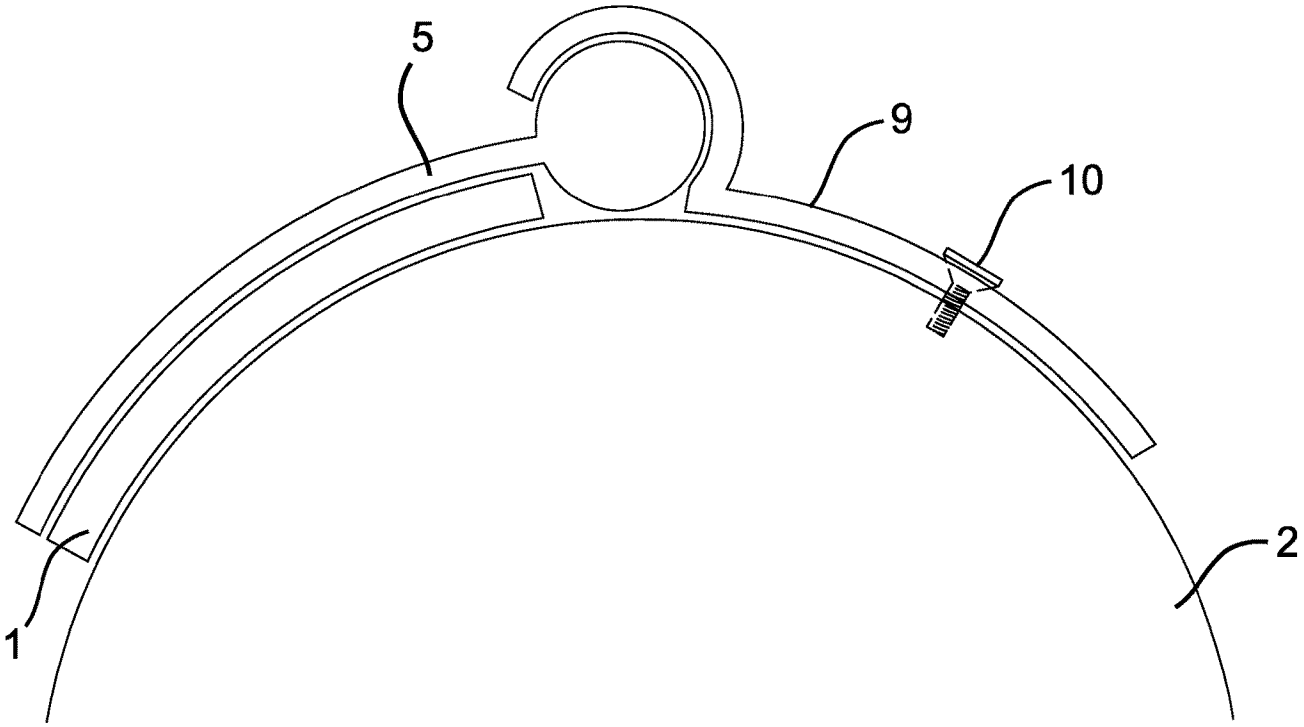

FIGS. 3A and 3B show two views depicting the sound-attenuating panel 1, the roller drum 2, and one embodiment of an interlocking system comprising 5, 9, and 10. Shown in FIG. 3A, convex coupling mechanism 5 is disposed longitudinally on the upper side of the sound-attenuating panel 1. Coupling mechanism 5 comprises a first flat surface and a second flat surface, a round elongated edge, and a flat elongated edge opposite the round edge as shown in FIG. 3B. In this embodiment, one surface of the coupling mechanism 5 is joined to one surface of the upper side of sound-attenuating panel 1 by way of chemical attachment. In other embodiments, the coupling mechanism 5 is joined to the sound-attenuating panel 1 using adhesives, rivets, and mechanical attachments. In this embodiment, the coupling mechanism 5 is made of rubber. In other embodiments, the coupling mechanism 5 comprises polyvinyl chloride, plastic, aluminum, titanium, carbon fiber and acrylic. Also shown is a complimentary concave coupling mechanism 9 which is attached to the roller drum 2 using screws 10 intermittently spaced longitudinally along the roller drum 2. FIG. 3B shows a profile view of the coupling mechanism 9 affixed to the roller drum 2 using screws 10 and overlapping the round edge of the coupling mechanism 5 which is joined to the sound-attenuating panel 1 thus removably attaching the sound-attenuating panel 1 to the roller drum 2. In one embodiment the coupling mechanism 9 is made of aluminum. In other embodiments, the coupling mechanism 9 is made of steel, stainless steel, titanium, polyvinyl chloride, polyoxymethylene, carbon fiber, and plastic.

Figure 4A:
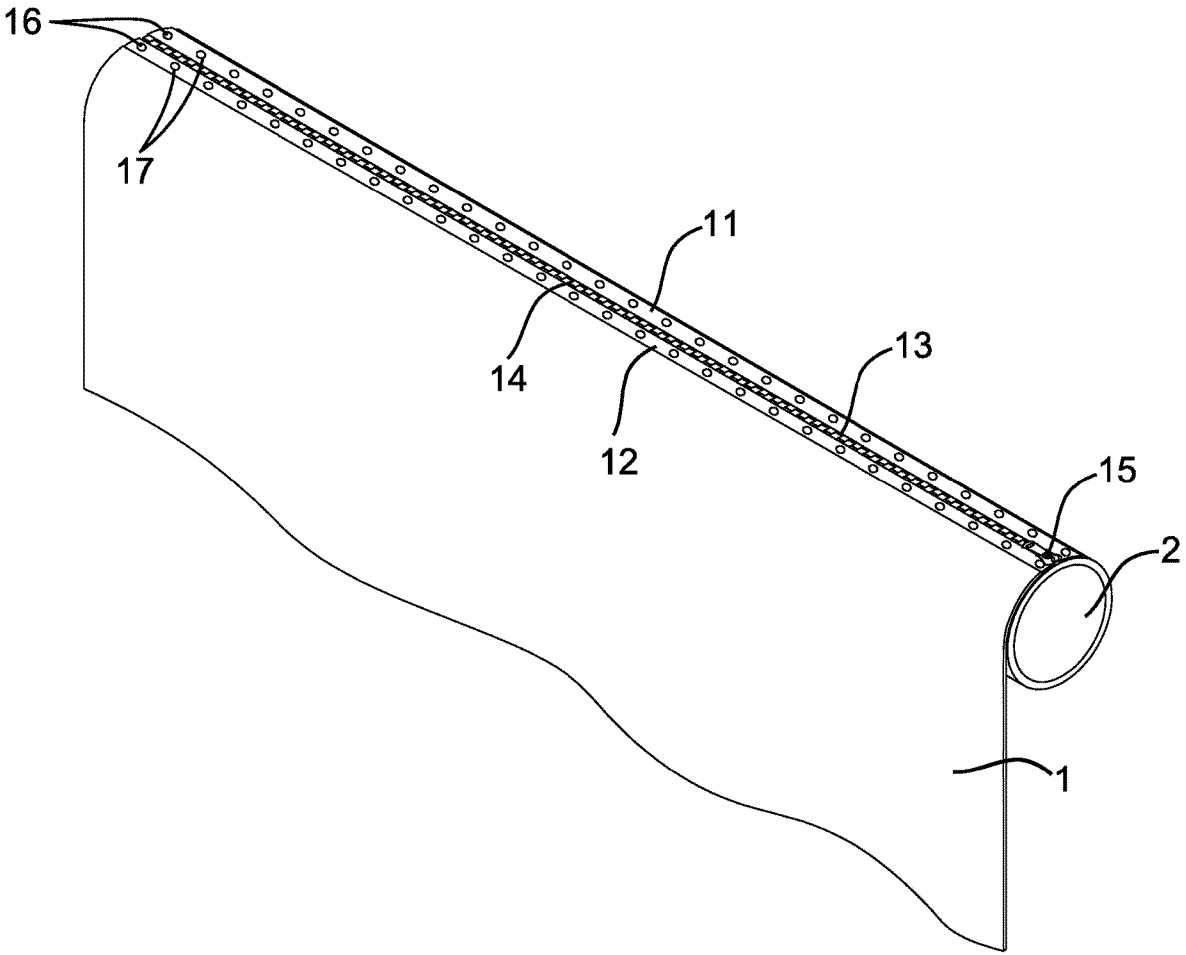
Figure 4B:
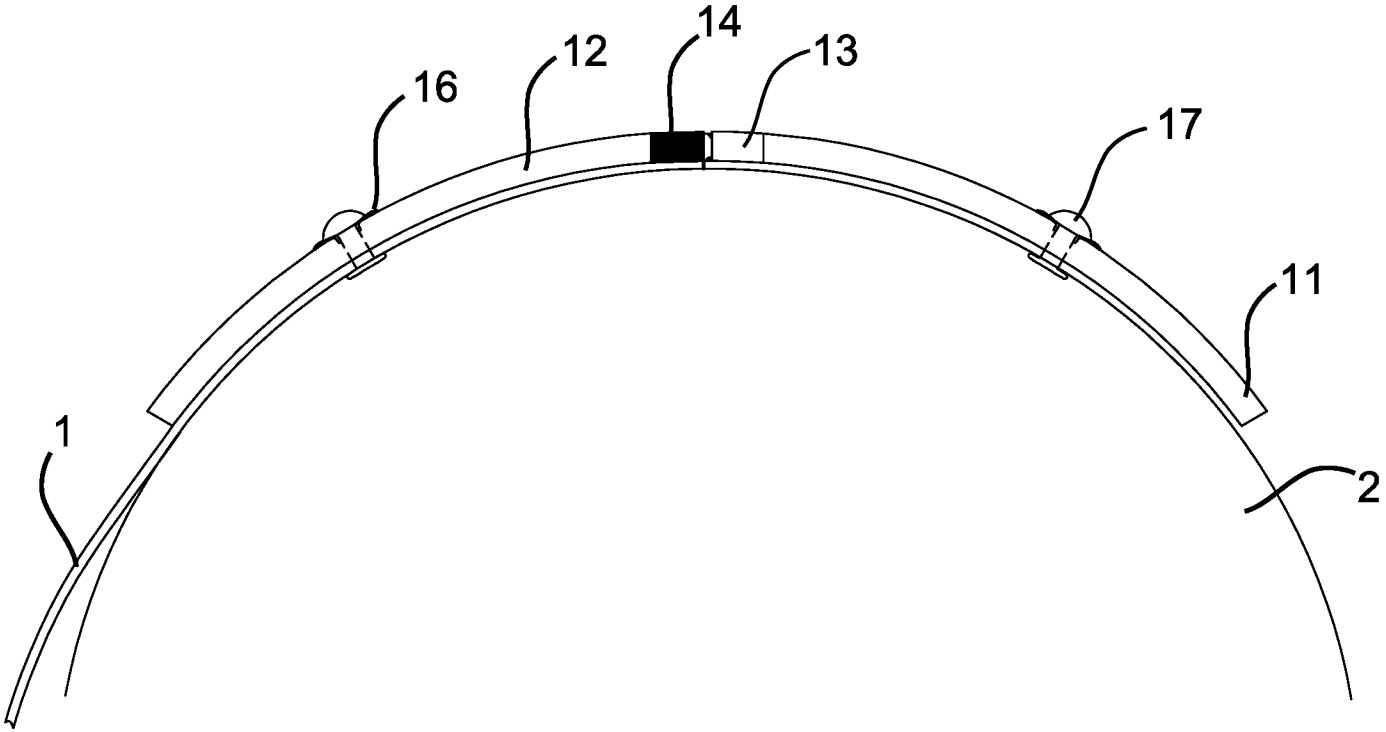

FIGS. 4A and 4B provide two views of one embodiment of an interlocking system. FIG. 4A is an isometric view of the sound-attenuating panel 1, the roller drum 2, and one embodiment of the interlocking system comprising a first binding 11 and a second binding 12, a first coupling mechanism 13 having a first end and a second end, a complimentary second coupling mechanism 14 having a first end and a second end, a slide 15 having a first cavity and a second cavity, grommets 16 and rivets 17. The first binding 11 has a first elongated side, a second elongated side, a first end, a second end, a first flat surface, and a second flat surface. The first binding 12 has a first elongated side, a second elongated side, a first end, a second end, a first flat surface, and a second flat surface. FIG. 4B shows a profile view depicting the sound-attenuating panel 1, the roller drum 2, the first binding 11, the second binding 12, the first coupling mechanism 13, the second complimentary second coupling mechanism 14, grommets 16 and rivets 17. In this embodiment, the first binding 11 is disposed longitudinally the length of the roller drum 2, and is attached to the roller drum 2 using grommets 16 and rivets 17. The second binding 12 is disposed longitudinally and attached to the upper side of the sound-attenuating panel 1 with grommets 16 and rivets 17. The first coupling mechanism 13 is attached to first side of binding 11. The complimentary second coupling mechanism 14 is attached to the first side of binding 12. Binding 12 is joined to a surface of the sound-attenuating panel 1 such that the first side is upward and the coupling mechanism 14 extends above the upper side of the sound-attenuating panel 1. Binding 11 is joined to the roller drum 2 such that the first side, with the coupling mechanism 13, is downward. The first end of the first coupling mechanism 13 is disposed inside the first cavity of Slide 15. The first end of the complimentary second coupling mechanism 14 is inserted into the second cavity of slide 15. When slide 15 is moved longitudinally along the drum, the first coupling mechanism 13 engages the complimentary second coupling mechanism 14, removably attaching the sound-attenuating panel 1 to the roller drum 2. In this embodiment, the first binding 11 and the second binding 12 are made of cloth. The first coupling mechanism 13 and complimentary second coupling mechanism 14 are made of metal, with a chain crosswise strength of at least 150 pounds per 2.5 cm. In other embodiments, the first and second bindings 11 and 12 and the first and second coupling mechanisms 13 and 14 comprise chloroprene, polyurethane, and polyvinyl chloride. In other embodiments, the first binding 11 is joined to roller drum 2 using fasteners comprising adhesives, rivets, nuts and bolts, clips, and snaps. The second binding 12 is attached to the sound-attenuating panel 1 using fasteners comprising adhesives, rivets, clips, chemical and mechanical attachments, and snaps.

Figure 5:
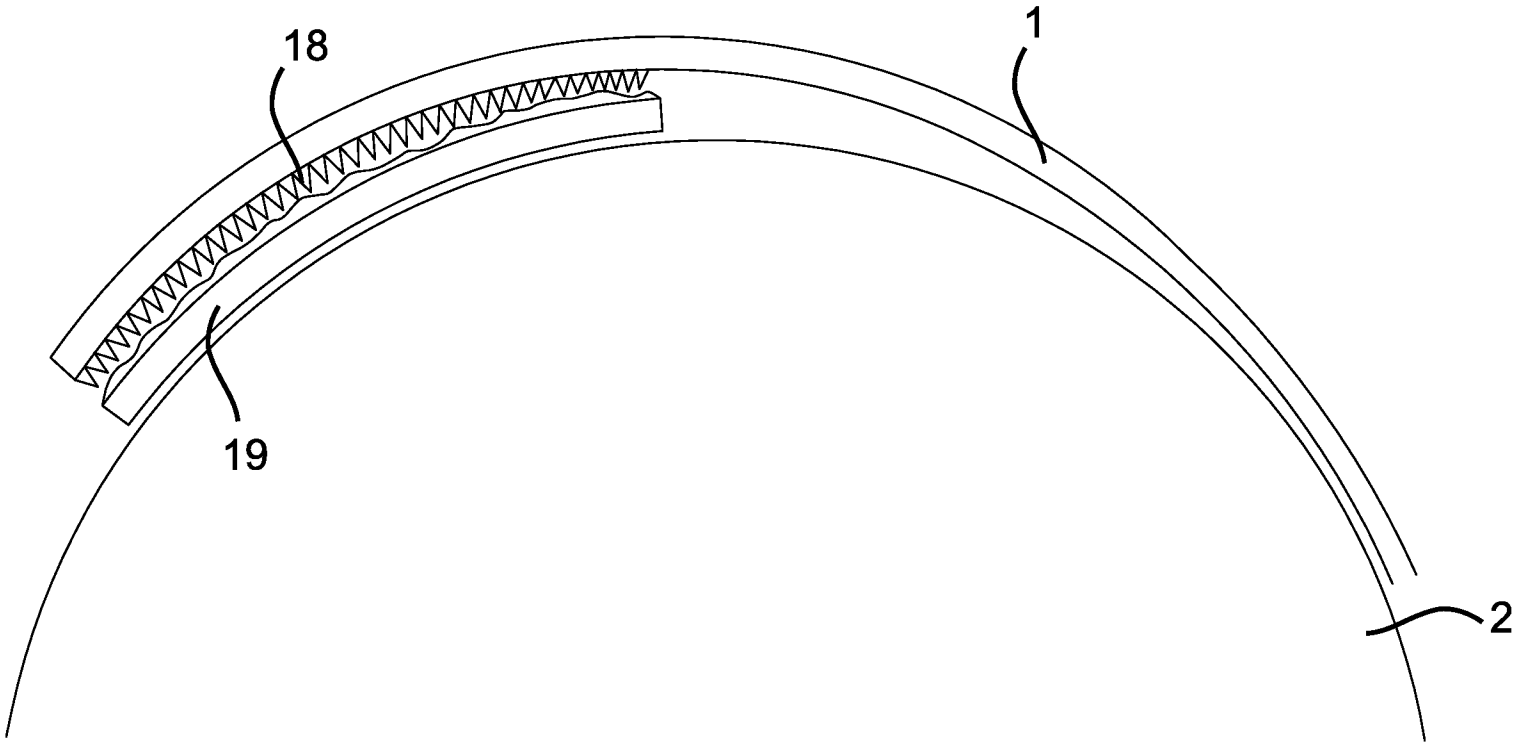

FIG. 5 is a profile view of the sound-attenuating panel 1, the roller drum 2, and one embodiment of the interlocking system comprising hook binding 18 and loop binding 19. Hook binding 18 is joined along the upper side of the sound-attenuating panel 1 longitudinally. Loop binding 19 is joined to roller drum 2 longitudinally the length of the roller drum 2. The hook binding 18 interlocks with the loop binding 19 to removably attach the sound-attenuating panel 1 to the roller drum 2. In one embodiment, the hook binding 18 is joined to the sound-attenuating panel 1 and the loop binding 19 is joined to the roller drum 2 using adhesive. In other embodiments, the hook binding 18 is joined to the sound-attenuating panel 1 by way of thread stitching, chemical and mechanical attachments, and rivets. In other embodiments, the loop binding 19 is joined to the roller drum 2 by way of grommets, rivets, and screws.

Figure 6A:
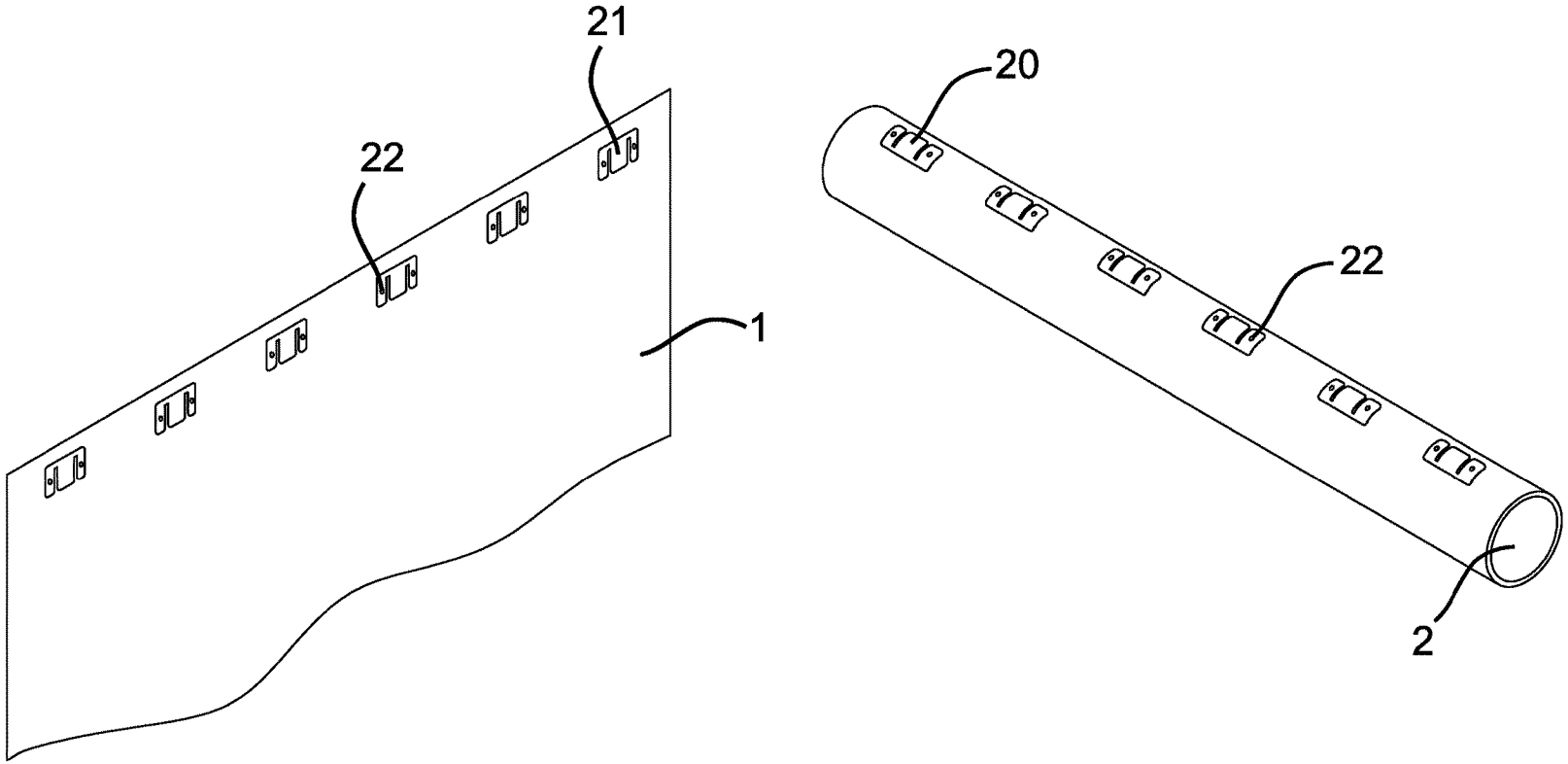
Figure 6B:
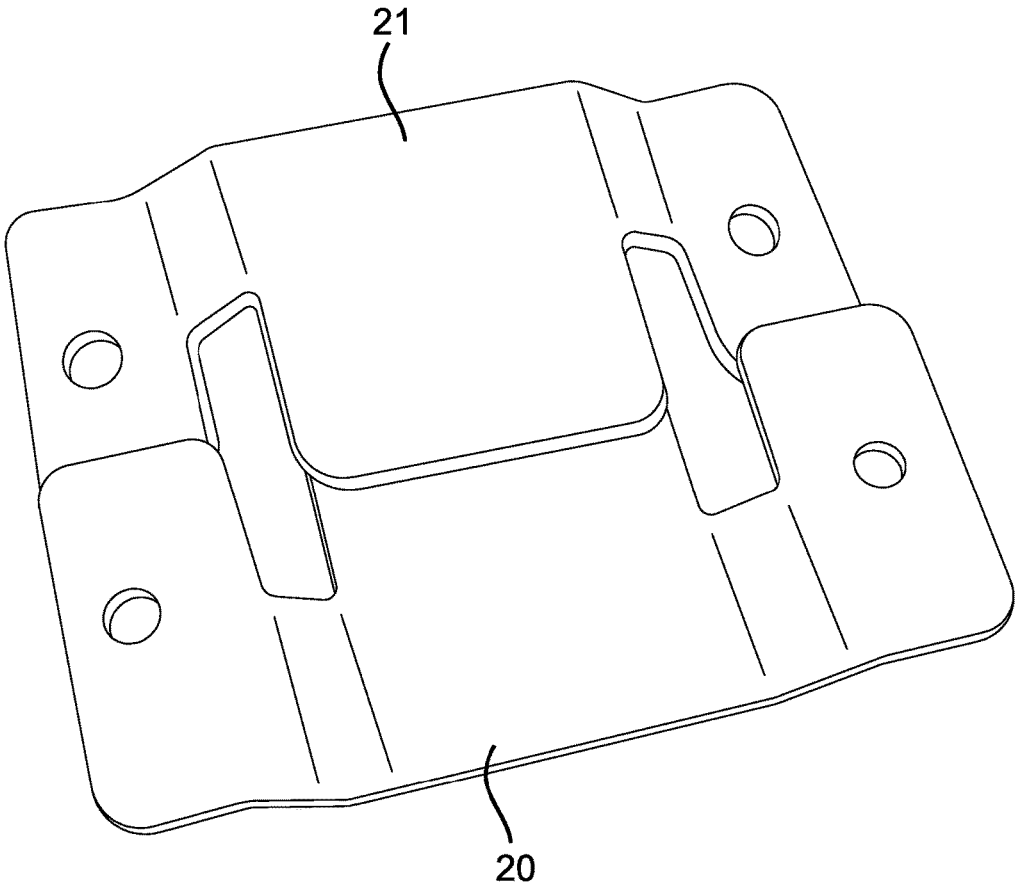

FIGS. 6A and 6B show views and details of the sound-attenuating panel 1, the roller drum 2, an embodiment of an interlocking system comprising a first sectional connector bracket 20 and a second sectional connector bracket 21, and fasteners 22. Shown in FIG. 6A, a plurality of first sectional connector brackets 20 are intermittently spaced longitudinally along the length of the roller drum 2. A plurality of complimentary second sectional connector brackets 21 are intermittently spaced along the upper side of the sound-attenuating panel 1, and positioned complimentary to brackets 20. FIG. 6B shows an isometric view depicting the first sectional connector bracket 20 and the complimentary second sectional connector bracket 21. In one embodiment, the first sectional connector brackets 20 and the complimentary second sectional connector brackets 21 are comprised of aluminum. In other embodiments, first sectional connector brackets 20 and the complimentary second sectional connector brackets 21 comprise carbon fiber, polyvinyl chloride, plastic, brass, steel, stainless steel, and titanium. The second sectional connector brackets 21 are joined to the sound-attenuating panel 1 using grommets and rivets. In one embodiment, the first sectional connector brackets 20 are joined to the roller drum 2 using fasteners 22 comprising rivets. In other embodiments, the first sectional connector brackets 20 are joined to the roller drum 2 using fasteners comprising screws, nuts and bolts, and mechanical attachments.

Figure 7:
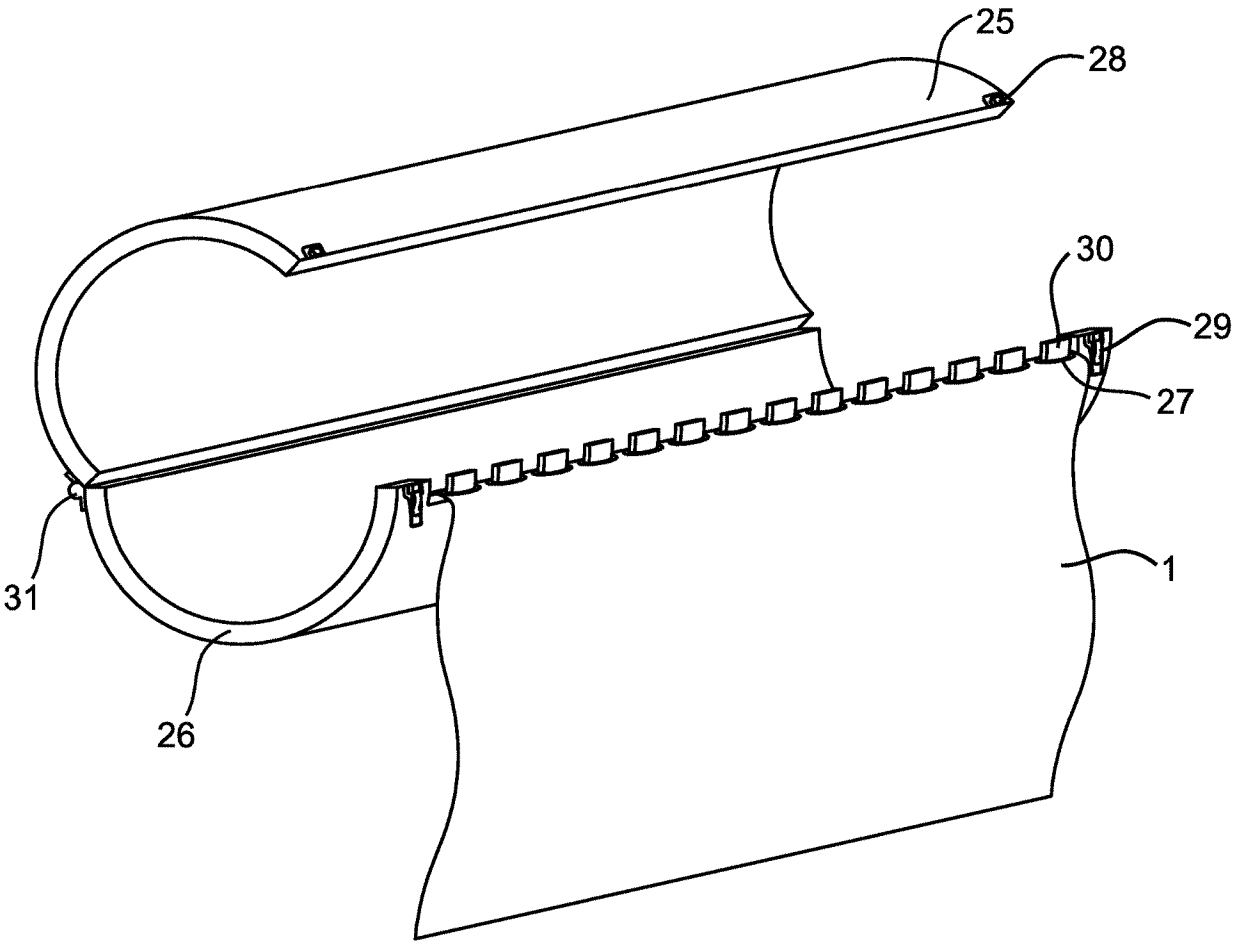

FIG. 7 shows a front view depicting an interlocking system comprising the sound-attenuating panel 1, a first clam-shell roller drum section 25, a second clam-shell roller drum section 26, grommets 27, a first latch 28, a complimentary second latch 29, coupling elements 30, and a plurality of hinges 31. The first clam-shell roller drum section 25 comprises the first half of a pipe with a first elongated straight edge, a second elongated straight edge, a first curved end, and a second curved end. The second clam-shell roller drum section 26 comprises the second half of a pipe with a first elongated straight edge, a second elongated edge intermittently notched to create coupling elements 30, a first curved end, and a second curved end. In this embodiment, the first elongated edge of the first clam-shell roller drum section 25 is connected to the first elongated edge of the second clam-shell roller drum section 26 using a plurality of hinges 31 intermittently spaced and disposed longitudinally. In one embodiment, the hinges 31 are attached to the first clam-shell roller drum section 25 and the second clam-shell roller drum section 26 using nuts and bolts. In other embodiments, the hinges 31 are attached using fasteners comprising screws, rivets, and mechanical welds. Grommets 27 are intermittently spaced longitudinally along the upper end of the sound-attenuating panel 1, with a hole perforating the sound-attenuating panel 1 in the center of each grommet 27. Coupling elements 30 are notched such that the upper edge of each coupling element 30 is planar to the first elongated edge of the second clam-shell roller drum section 26. The first latch 28 is disposed at the first and second ends of the second elongated edge of first clam-shell roller drum section 25. The complimentary second latch 29 is disposed at the first and second ends of the second elongated edge of the second clam-shell roller drum section 26. The first latch 28 is interlocked with the complimentary second latch 29 to detachably join the second elongated edge of the clam-shell roller drum section 25 to the second elongated edge of the clam-shell roller drum section 26. In one embodiment, the first latch 28 and complimentary second latch 29 comprise case latches. In other embodiments, the first latch 28 and complimentary second latch 29 may comprise sash latches, bar latches, toggle clamps, spring clamps, and hook latches.

Figure 8:
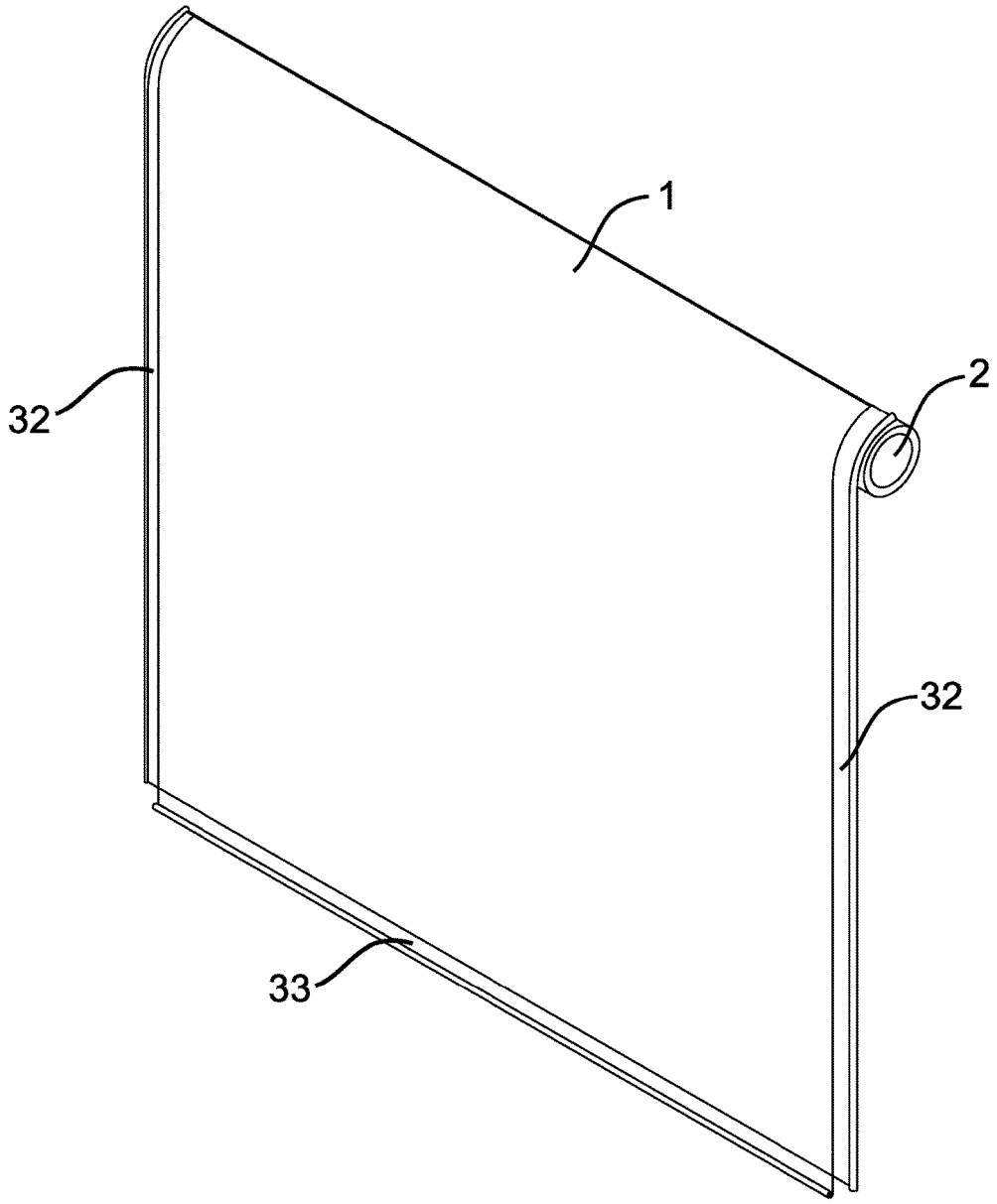
FIG. 8 shows the flexible panel attached to a roller drum, with flexible, sound-attenuating guides on either vertical side of the wall, and a flexible, sound-attenuating seal along the lower end of the flexible panel.

FIG. 8 shows an isometric view depicting the sound-attenuating panel 1, the roller drum 2, a first and a second flexible, sound-attenuating guide 32, and a flexible, lower sound-attenuating seal 33. The first flexible, sound-attenuating guide 32 is disposed vertically along the first vertical side of the sound-attenuating panel 1 and the second flexible, sound-attenuating guide 32 is disposed vertically along the second vertical side of the sound-attenuating panel 1. The sound-attenuating lower seal 33 is disposed horizontally along the lower side of the sound-attenuating panel 1.

Figure 9:
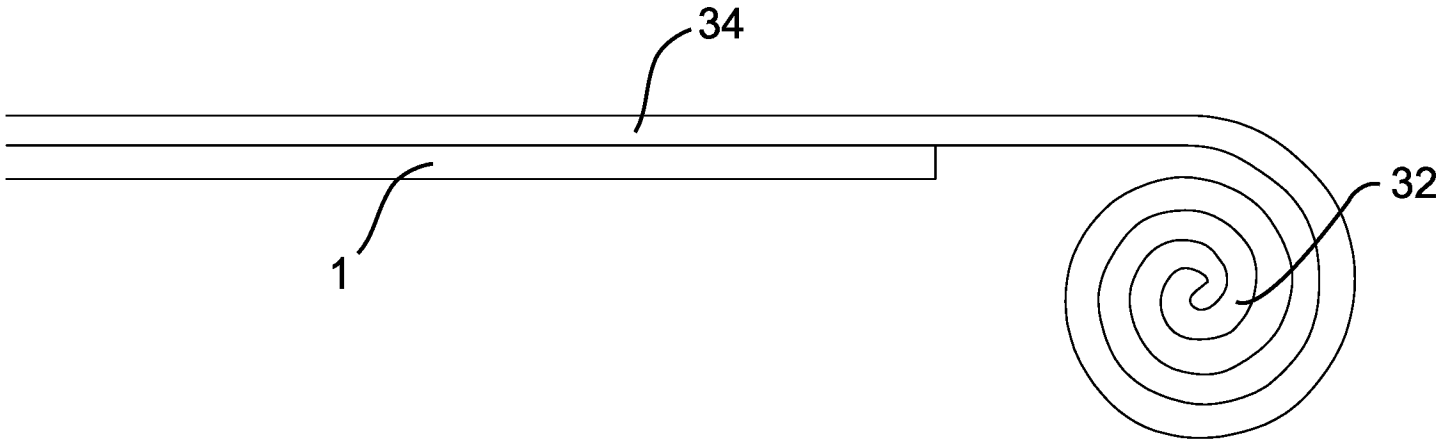
FIG. 9 provides a plan view of a flexible, sound-attenuating guide joined to the flexible, sound-attenuating wall.

FIG. 9 shows a plan view of the sound-attenuating panel 1 and a flexible, sound-attenuating guide 32. The first and second flexible, sound-attenuating guides 32 are comprised of strips of mass-loaded vinyl which is rolled along the longitudinal edge to form the sound-attenuating guides 32, and leaving an extension of flat, flexible, sound-attenuating material 34. The rolls of the sound-attenuating guides 32 are secured using adhesives or chemical and mechanical attachments. One surface of the extension 34 is joined to one surface of the sound-attenuating panel 1 on the first and second vertical sides. In one embodiment, one surface of the extension 34 is joined to one surface of the sound-attenuating panel 1 using adhesive. In other embodiments, the extension 34 is joined to the sound-attenuating panel 1 using chemical and mechanical attachments.

Figure 10:
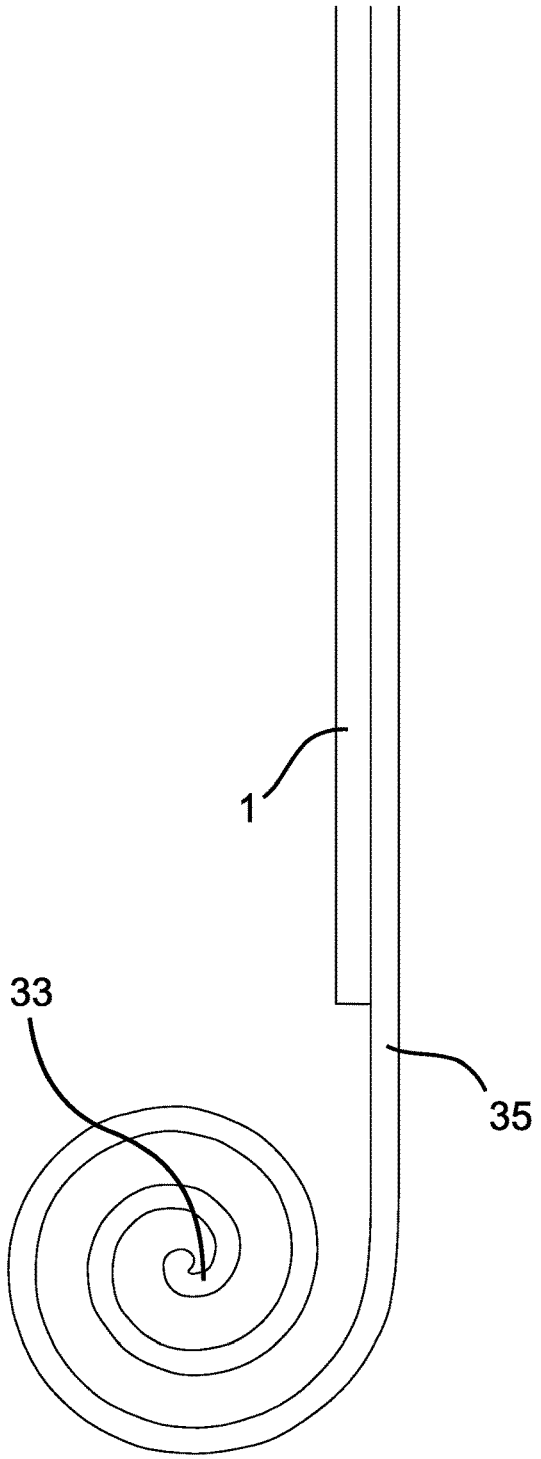
FIG. 10 provides a profile view of the flexible, sound-attenuating seal joined at the lower end of the flexible, sound-attenuating wall.

FIG. 10 shows a profile view of the sound-attenuating panel 1 and a flexible, sound-attenuating lower seal 33. The flexible, sound-attenuating lower seal 33 is comprised of a strip of mass-loaded vinyl which is loosely rolled along the longitudinal edge, leaving an extension of flat, flexible, sound-attenuating material 35. One surface of the extension 35 is joined to one surface of the sound-attenuating panel 1 on the lower side. The rolls of the sound-attenuating lower seal 33 are secured using adhesives or chemical and mechanical attachments. In one embodiment, one surface of the extension 35 is joined to one surface of the sound-attenuating panel 1 using adhesive. In other embodiments, the extension 35 is joined to the sound-attenuating panel 1 using chemical and mechanical attachments.

Figure 11:
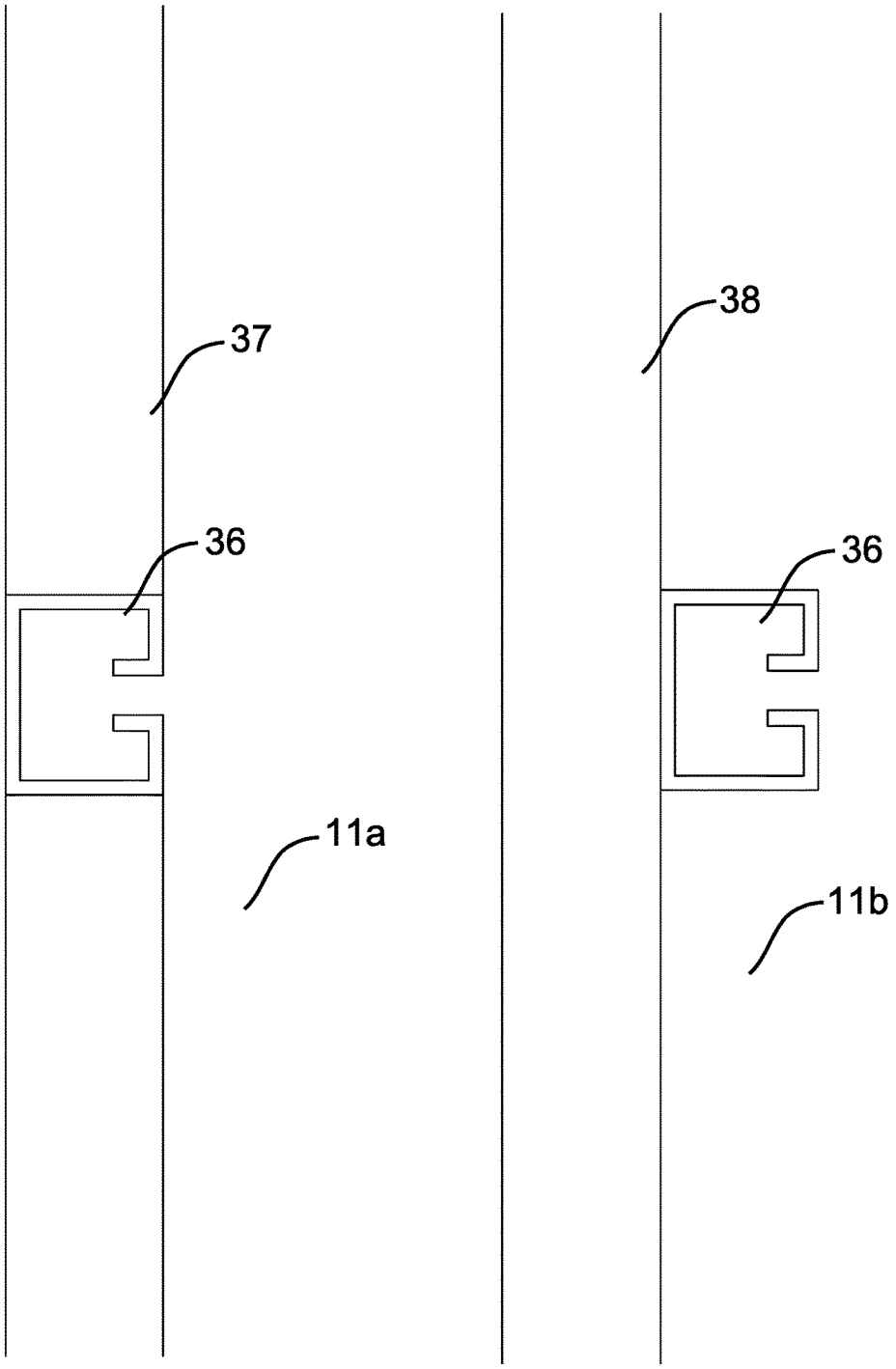
FIG. 11 provides multiple plan views of the guide receiver channel. In the first embodiment the channel is embedded in a vertical structure. In the second embodiment the guide channel is attached to the front surface of a vertical structure.

FIG. 11 shows a plan view of the guide receiver channel 36. In view 11*a*, the guide receiver channel 36 is embedded in a vertical structure 37. In view 4*b*, guide receiver channel 36 is attached to the surface of a vertical structure 38. The guide receiver channel 36 comprises steel, stainless steel, aluminum, titanium, alloys, polyvinyl chloride, nylon, and plastic, and has an inner and outer surface. Guide receiver channel 36 comprises a friction resistant material disposed on the inner surface using nylon, ultra-high molecular weight polyethylene, titanium nitride, chromium nitride, and polytetrafluoroethylene.

Figure 12:
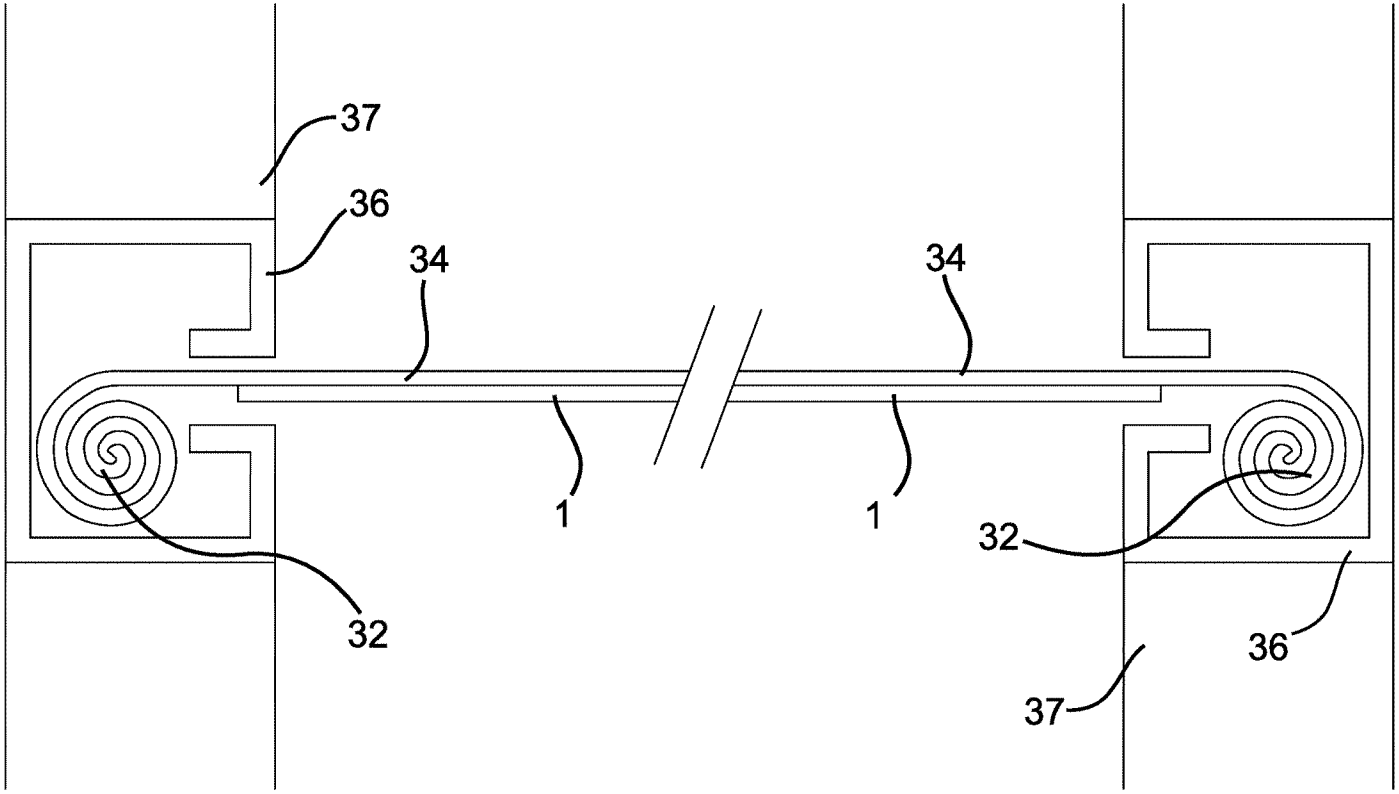
FIG. 12 provides a plan view of the flexible, sound-attenuating guide engaging the guide receiver channel. In this embodiment, the channel is shown embedded in a vertical wall.

FIG. 12 shows a plan view of the sound-attenuating panel 1, the guide receiver channel 36, the flexible, sound-attenuating guide 32 and extension 34, and vertical structures 37. There is a first and a second guide receiver channel wherein the first guide receiver channel 36 is vertically attached to a first structure and the second guide receiver channel is vertically attached to an opposing second structure in the same space. The flexible, sound-attenuating guide 32 aligns with and slides inside the guide receiver channel 36 as the sound-attenuating panel 1 deploys and retracts.

Figure 13:
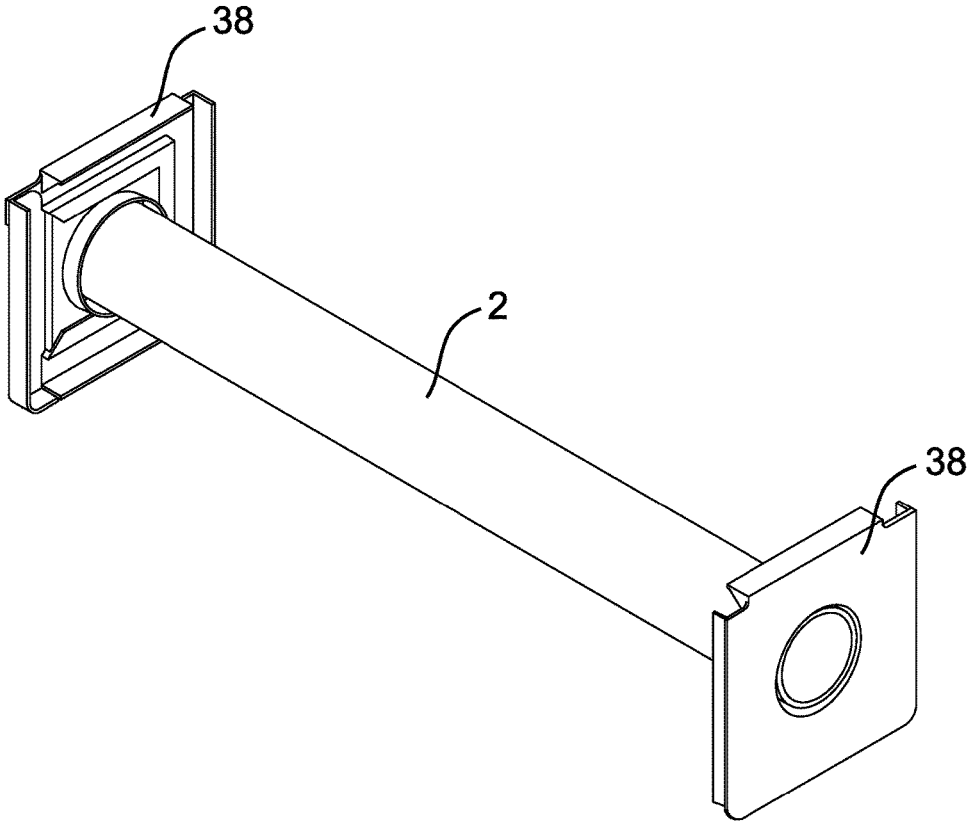
FIG. 13 depicts the roller drum supported on either end of the drum by mounting brackets.

FIG. 13 shows an isometric view of the roller drum 2 comprising a first end and a second end, and a first and a second mounting bracket 38. In one embodiment, the first and second mounting brackets 38 attach to a horizontal structure, the first bracket coupled to and supporting the first end of the roller drum 2 and the second bracket coupled to and supporting the second end of the roller drum 2. In another embodiment, the first and second mounting brackets 38 attach to a vertical structure. The first and second mounting brackets 38 are comprised of steel, stainless steel, aluminum, brass, titanium, polyvinyl chloride, carbon fiber, nylon, polyoxymethylene and plastic.

We claim:

1. A roll-up wall comprising:

a sound-attenuating panel having an upper side, a lower side, a first vertical side, and a second vertical side;

a clam-shell roller drum comprising two half pipes joined by spaced apart hinges along two longitudinal sides and spaced apart tabs and notches along a first opposed longitudinal side to accept an interlocking system of the sound-attenuating panel, the clam-shell roller drum further comprising latches adjacent the respective ends of the first opposed longitudinal side and a second opposed longitudinal side to clamp the adjoining opposed longitudinal sides together;

a winding mechanism comprising a power cord disposed inside and attached to the clam-shell roller drum;

a first mounting bracket and a second mounting bracket;

the first mounting bracket coupled to and supporting one end of the clam-shell roller drum and the second mounting bracket coupled to and supporting the opposite end of the clam-shell roller drum;

a first flexible, sound-attenuating guide and a second flexible, sound attenuating guide;

the first flexible, sound-attenuating guide joined to the first vertical side and the second flexible, sound-attenuating guide joined to the second vertical side;

a first guide receiver channel and a second guide receiver channel;

the first guide receiver channel vertically attached to a first vertical side of a structure opening and the second guide receiver channel vertically attached to an opposing second side of the structure opening;

the first sound-attenuating guide disposed within the first guide receiver channel and the second sound-attenuating guide disposed within the second guide receiver channel;

a flexible, sound-attenuating seal joined to the sound-attenuating panel along the lower side of the panel;

the interlocking system comprising a plurality of coupling elements intermittently spaced longitudinally along the upper end of the sound-attenuating panel comprising grommets with a hole perforating the sound-attenuating panel in the center of each grommet commensurate with the spaced apart tabs and notches of the first opposed longitudinal side of the clam-shell roller drum, the coupling elements being inserted onto the respective tabs and notches, attaching the sound-attenuating panel to the clam-shell roller drum, the tabs comprising a notched upper edge coupling to the second opposed longitudinal side of the clam-shell roller drum such that the notch allows the respective opposed longitudinal sides to form a planar connection when the roller drum is closed.

2. The roll-up wall of claim 1, wherein the sound-attenuating panel comprises mass loaded vinyl.

3. The roll-up wall of claim 1, wherein the clam-shell roller drum comprises metal which is selected from the group consisting of steel, stainless steel, aluminum, brass, and titanium.

4. The roll-up wall of claim 1, wherein the clam-shell roller drum comprises material which is selected from the group consisting of polyvinyl chloride, carbon fiber, wood, engineered wood, nylon, and plastic.

5. The roll-up wall of claim 1, wherein the winding mechanism disposed inside and attached to the clam-shell roller drum rotates the clam-shell roller drum on its longitudinal axis to raise or lower the sound-attenuating panel.

6. The roll-up wall of claim 1, wherein the mounting brackets comprise metal selected from the group consisting of steel, stainless steel, aluminum, brass, and titanium.

7. The roll-up wall of claim 1, wherein the mounting brackets comprise material selected from the group consisting of polyvinyl chloride, carbon fiber, nylon, polyoxymethylene, and plastic.

8. The roll-up wall of claim 1, wherein the first and second flexible, sound-attenuating guides each comprise a strip of mass-loaded vinyl rolled longitudinally and joined to itself to form a bead using chemical or mechanical attachment, or combinations thereof.

9. The roll-up wall of claim 1, wherein the flexible, sound-attenuating guides are joined to the sound-attenuating panel using chemical or mechanical attachments, or combinations thereof.

10. The roll-up wall of claim 1, wherein the first and second guide receiver channels each comprise an inner surface and an outer surface.

11. The roll-up wall of claim 1, wherein the first and second guide receiver channels each comprise metals selected from the group consisting of steel, stainless steel, aluminum, brass, titanium, and alloys.

12. The roll-up wall of claim 1, wherein the first and second guide receiver channels each comprise materials selected from the group consisting of polyvinyl chloride, nylon, polyoxymethylene, and plastic.

13. The roll-up wall of claim 1, wherein the first and second guide receiver channels are affixed vertically to the structures by chemical or mechanical attachments, or combinations thereof.

14. The roll-up wall of claim 1, wherein the first and second guide receiver channels comprise a friction resistant material disposed on an inner surface of the channels.

15. The roll-up wall of claim 14, wherein the friction resistant material disposed on the inner surfaces of the guide receiver channels is selected from the group consisting of nylon, ultra-high molecular weight polyethylene, titanium nitride, chromium nitride, and polytetrafluoroethylene.

16. The roll-up wall of claim 1, wherein the sound-attenuating seal comprises a strip of mass-loaded vinyl rolled longitudinally and joined to itself to form a bead using chemical or mechanical attachments, or combinations thereof.

17. The roll-up wall of claim 1, wherein the sound-attenuating seal is joined to the lower side of the sound-attenuating panel using chemical or mechanical attachments, or combinations thereof.

18. The roll-up wall of claim 1, wherein the sound-attenuating seal creates a substantially sound-attenuating barrier between the sound-attenuating panel and a floor when the panel is fully deployed.

19. The roll-up wall of claim 1, wherein the first and second longitudinal sides of the clam-shell roller drum comprise case latches adjacent the respective ends of the roller drum.

20. The roll-up wall of claim 1, wherein the interlocking system comprises 14 tabs and notches along the first opposed longitudinal side of the clam-shell roller drum.

* * * * *